United States Patent [19]

Shore et al.

[11] 3,935,401

[45] Jan. 27, 1976

[54] EARPIECE FOR ACOUSTIC HEADSET

[76] Inventors: Sidney X. Shore, 29 Wren Drive, Roslyn, N.Y. 11576; Paul S. Martin, 189-54 43rd Road, Flushing, N.Y. 11358

[22] Filed: Aug. 29, 1974

[21] Appl. No.: 501,689

[52] U.S. Cl. ..... 179/182 R; 181/135

[51] Int. Cl.[2] ..... H04R 1/10

[58] Field of Search ..... 179/182 R, 107 E, 1 ST, 179/156 R; 181/135, 129, 130, 131; 128/2.05 S, 151, 152

[56] References Cited

UNITED STATES PATENTS 3,772,478 11/1973 McCabe et al. ..... 179/1 ST 3,789,164 1/1974 Ryder ..... 179/156 R

*Primary Examiner*—Thomas W. Brown

[57] ABSTRACT

An earpiece having a tubular hub for receiving a sound-transmitting tube has a flange on an end of the hub about a central passage, comprising radiating ribs which are mutually separated by radiating slots or by webs. More particularly, the webs slope and the ribs adjoining the slots have marginal webs that are staggered in relation to each other, all as viewed in circular cross-section centered about the central passage. Still further, a tubular projection extends the central passage beyond the flange.

16 Claims, 7 Drawing Figures

FIG. 1
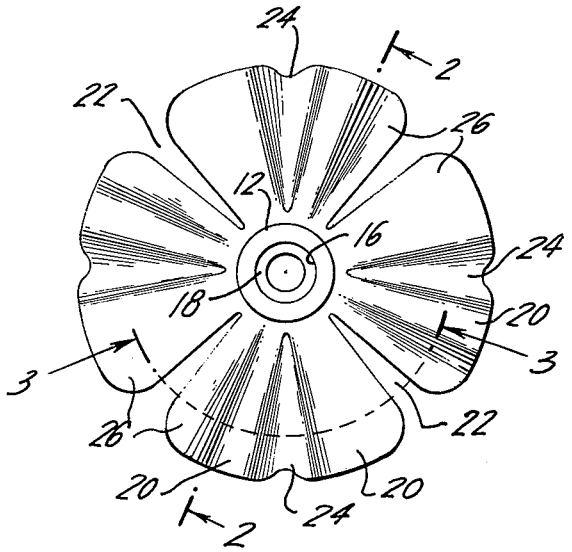
FIG. 2
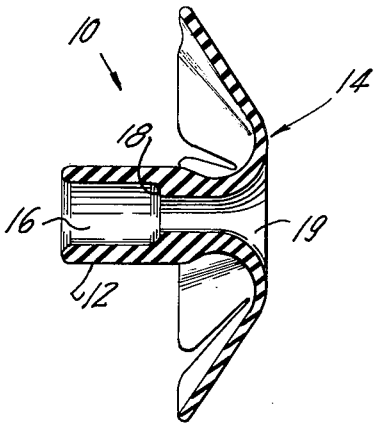
FIG. 3
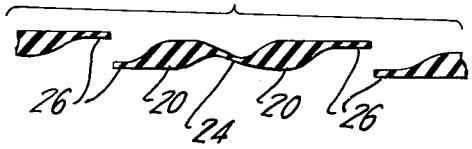
FIG. 5
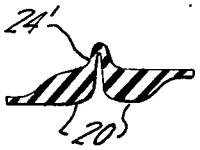
FIG. 5A
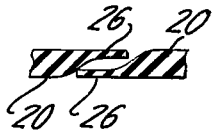
FIG. 4
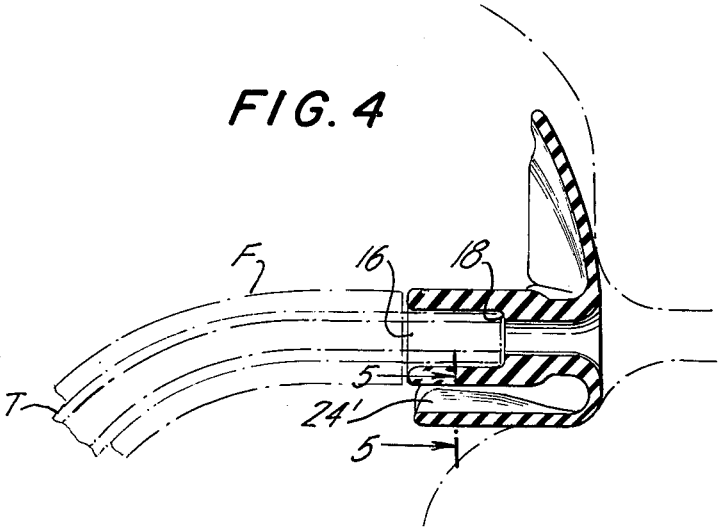
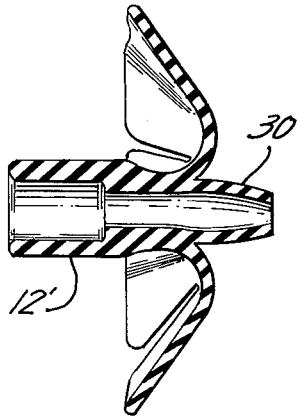
FIG. 6

EARPIECE FOR ACOUSTIC HEADSET

FIELD OF THE INVENTION

This invention relates to acoustic headsets, and more particularly to earpieces for such headsets.

BACKGROUND OF THE INVENTION

Acoustic headsets having sound-transmitting tubes are fitted with earpieces designed to engage the wearer's outer ear. Such earpieces have a central hub that receives the acoustic tube, and a flange projecting symmetrically from the hub which is intended to seal against the outer ear in the region of the ear canal, and to become deformed as the wearer adjusts the center of the earpiece into position communicating effectively with the ear canal. While the purpose is well conceived, the result has been poor. Few users are able to adjust the central passage of the earpiece opposite the ear canal, because the flange, despite its supple quality, nevertheless resists placement of the earpiece to the desired sound-coupling position.

SUMMARY OF THE INVENTION

In the novel earpiece, the flange is at least weakened at places, by radiating slots or by webs or by slots at some places and webs elsewhere, so that extreme deformation of the flange at one region can occur without imposing needless distortion on the rest of the flange. Anyone who has embraced an egg with his fingers and tried to crush the seemingly frail eggshell has been impressed with the enormous resistance of the shell in relation to circular compressive forces that develop in the shell. The material of the shell is well suited to resist such stresses. The flange of an earpiece of conventional design is circularly symmetrical, and despite its soft material, it is a symmetrical figure of revolution of uniform thickness, and each region develops surprising resistance to deforming stresses developed when prominent deformation is imposed elsewhere. By using thinned regions, or sloping webs amounting to corrugations, or slots, or combinations of these, one region of the flange is encouraged to wrinkle or to shrink so as to allow the central passage of the earpiece to be moved opposite a wearer's ear canal and yet the remainder of the flange can stand out and become conformed reasonably to the wearer's outer ear, acting with reasonable effectiveness to exclude ambient sounds.

The illustrative embodiments of the invention described in detail below are shown in the accompanying drawings, wherein:

FIG. 1 is an enlarged rear view of a novel earpiece embodying features of the invention;

FIG. 2 is a cross-section of the novel earpiece viewed at the plane 2—2 in FIG. 1;

FIG. 3 is a fragmentary cross-section of the earpiece of FIG. 1 as viewed along the cylindrical surface 3—3 in FIG. 1;

FIG. 4 is an enlarged view of the earpiece of FIGS. 1–3 in position opposite a wearer's outer ear shown diagrammatically in phantom lines and including portions of the headset that bears the earpiece, such portions also being shown in phantom lines;

FIG. 5 is a fragmentary view of a portion of an earpiece distorted in the region of section line 5—5 in FIG. 4;

FIG. 5A is another view similar to FIG. 5, showing another flange portion of a distorted earpiece; and FIG. 6 is a modified earpiece viewed in cross-section similar to FIG. 2.

The earpiece 10 includes a tubular hub 12 and a flange 14. A through axial passage 16 has a cylindrical portion ending with an annular abutment 18 for the end of a pliable acoustic tube T of a stereo headset carried by a light plastic frame F. Passage 16 extends from the reduced-diameter portion adjacent abutment 18 to a flared opening 19 formed by flange 14.

Flange 14 includes many relatively thick portions or ribs 20 (eight ribs in the form illustrated) extending outward from the tubular hub 12, in a generally conical configuration. When placed against a person's ear, the slight weight of the stereo headset forces the lower ribs to bend. Being spaced apart initially, the ribs move readily toward one another, allowing the earpiece to become aligned with the ear canal of the wearer, and then to support the headset. If the ribs were part of a soft wall of uniform thickness, this action could not occur. This is because, in the case of the uniform wall, the wall cannot be compressed in a circular direction (e.g. along line 3—3) to a comparable extent by such light forces, and required deformation of the flange in one region is resisted to a remarkable degree by the rest of the flange. In the case of earpieces that depend upon deformation of such a flange, it is difficult to find the right fit, such that the passage of the earpiece and the wearer's ear canal are aligned.

As shown, ribs 20 are divided and separated by notches 22 at some points. Webs 24 and 26 are provided for excluding ambient sound. Thin webs 24 extend from rib to rib. Such webs readily form folds when the ribs are bent, as represented by web 24' in FIGS. 4 and 5. Webs 26 may become overlapped as shown in FIG. 5A. While not readily apparent in the drawing, webs 24 extend well into the transition region 19 between flange 14 and tubular portion 12. By like token, thinned webs may extend inward radially from the inner ends of notches 22. Webs 24 do not lie along an imaginary conical outer surface of flange 14, nor do they lie along an inner imaginary conical surface of flange 14. (This statement applies correspondingly where flange 14 is not conical but some other shape, as a figure of revolution about a central axis.) As viewed in circular cross-section (FIG. 3, and see line 3—3 in FIG. 1), webs 24 slope or slant and thus promote the formation of folds such as folded web 24'. Furthermore, as shown in FIG. 3, webs 26 at the lateral edges of notches 22 are disposed in different "planes", or staggered or mutually offset, as shown in FIG. 3. This promotes the overlapped configuration of FIG. 5A whereas, were the webs 26 "coplanar" or aligned, they would tend to become abutting and so resist localized collapse of the flange in the circular direction when the wearer attempts to align through passage 16 with his or her ear canal.

A modification is shown in FIG. 6, including a tubular extension 30 of the hub 12' which, in FIGS. 1–5, ends at flange 14. The tubular extension at once complements the rest of the earpiece in sound transmission into the ear canal of the user and excluding ambient sound, and in assuring proper location of the passage through the earpiece opposite the ear canal. The rest of the earpiece of FIG. 6 is not described here. It is in all respects (except as already noted) the same as that of FIGS. 1–5.

The described and illustrated embodiments of the invention are evidently amendable to varied modification, and therefore the invention should be construed in accordance with its full spirit and scope.

What is claimed is:

1. An earpiece for an acoustic headset proportioned for cooperating with the wearer's outer ear at the ear canal, said earpiece comprising a tubular portion having a through passage for sound transmission and for receiving an acoustic tube and having a flange portion on an end of the tubular portion, said flange portion being subdivided so as to comprise a plurality of ribs radiating from the tubular portion, the ribs being normally separated by radiating regions of at least reduced thickness.

2. An earpiece in accordance with claim 1, wherein at least certain of said ribs are interconnected by webs.

3. An earpiece in accordance with claim 2, wherein the interconnecting webs slope as the flange is viewed in circular cross-section.

4. An earpiece in accordance with claim 1, wherein at least certain of the radiating ribs are separated along at least part of their lengths by radiating slots.

5. The earpiece in accordance with claim 4, wherein the separated ribs are of reduced thickness along their margins to form narrow marginal webs.

6. The earpiece in accordance with claim 5, wherein the marginal webs at the edges of a slot are staggered.

7. The earpiece in accordance with claim 1, wherein groups of at least two of said radiating ribs per group are separated by radiating slots, and wherein each rib of each group is connected to the adjacent rib of the group by a web.

8. The earpiece in accordance with claim 7, wherein the ribs which are separated by slots have marginal webs that are staggered in relation to each other as viewed in circular cross-section.

9. The earpiece in accordance with claim 8, wherein said interconnecting webs slope as the flange is viewed in a circular cross-section about its center.

10. The earpiece in accordance with claim 1, further including a resilient tubular projection that extends the through passage beyond the flange.

11. An earpiece for an acoustic headset proportioned for cooperating with the wearer's outer ear at the ear canal, said earpiece comprising a tubular portion adapted at one end thereof for connection to an acoustic tube and having a through passage for sound transmission, said earpiece also comprising a flange at a position spaced from said one end thereof, said flange being divided by regions of at least reduced thickness into a plurality of elements extending outward relative to said tubular portion.

12. An earpiece in accordance with claim 11, wherein in the condition of the earpiece when not worn, said flange extends from said tubular portion progressively outward and toward the plane of said one end thereof.

13. An earpiece in accordance with claim 11, wherein said flange has webs interconnecting said elements at least at certain of said regions.

14. An earpiece in accordance with claim 11, wherein at least certain of said regions comprise slots extending outward in relation to said tubular portion.

15. An earpiece in accordance with claim 11, wherein at least certain of said regions comprise slots, each pair of elements divided by a slot having webs that are staggered in relation to each other as viewed in circular cross-section about the axis of the tubular portion for becoming overlapped when the elements are deformed in use.

16. An earpiece in accordance with claim 11, wherein said tubular portion extends beyond the flange in the direction remote from said one end thereof.

* * * * *